US007337902B2

(12) United States Patent
Rosdal

(10) Patent No.: US 7,337,902 B2
(45) Date of Patent: Mar. 4, 2008

(54) CASE FOR HEATED APPLIANCES

(75) Inventor: Aundrea Rosdal, Aurora, CO (US)

(73) Assignee: Hood, Inc., Aurora, CO (US)

( * ) Notice: Subject to any disclaimer, the term of this patent is extended or adjusted under 35 U.S.C. 154(b) by 67 days.

(21) Appl. No.: 11/423,358

(22) Filed: Jun. 9, 2006

(65) Prior Publication Data

US 2007/0284272 A1 Dec. 13, 2007

(51) Int. Cl.
*A45C 11/26* (2006.01)

(52) U.S. Cl. ..... 206/349; 219/242; 220/666

(58) Field of Classification Search ..... 206/305, 206/320, 349, 457, 701, 702; 132/268; 219/242; 220/666; D28/38
See application file for complete search history.

(56) References Cited

U.S. PATENT DOCUMENTS

| | | | | |
|---|---|---|---|---|
| 2,026,311 | A * | 12/1935 | Harris | 220/682 |
| 3,066,847 | A * | 12/1962 | Fortune | 206/524.1 |
| 3,946,196 | A | 3/1976 | Waters et al. | |
| 4,159,773 | A | 7/1979 | Losenno | |
| D261,317 | S | 10/1981 | Oberheim et al. | |
| 4,308,878 | A | 1/1982 | Silva | |
| D269,299 | S | 6/1983 | Oberheim | |
| 4,570,792 | A | 2/1986 | Conway | |
| D300,065 | S | 2/1989 | Zaborowski et al. | |
| 4,877,942 | A | 10/1989 | Raab | |
| D313,089 | S | 12/1990 | Schuler | |
| 5,054,615 | A | 10/1991 | Stillwagon et al. | |
| 5,062,529 | A | 11/1991 | Blair | |
| 5,141,189 | A | 8/1992 | Andrew | |
| 5,169,102 | A | 12/1992 | Bracken | |
| 5,203,456 | A | 4/1993 | Boswell | |
| D348,542 | S | 7/1994 | Cannella | |
| D350,230 | S | 9/1994 | O'Brien | |
| 5,503,294 | A * | 4/1996 | Taylor et al. | 220/571 |
| 5,562,209 | A | 10/1996 | Jackson et al. | |
| 5,568,809 | A | 10/1996 | Ben-haim | |
| 5,577,607 | A | 11/1996 | Drake et al. | |
| 5,638,955 | A | 6/1997 | Calciano | |
| 5,798,500 | A | 8/1998 | Stillwagon, Jr. et al. | |
| 5,950,826 | A | 9/1999 | Lykowski | |
| 6,068,122 | A | 5/2000 | Burns et al. | |
| 6,109,446 | A | 8/2000 | Foote | |
| D454,683 | S | 3/2002 | Brown | |
| 6,808,066 | B2 | 10/2004 | Bean | |
| D508,146 | S | 8/2005 | LeBlanc | |
| 2005/0161353 | A1 | 7/2005 | Devine | |
| 2006/0266754 | A1 * | 11/2006 | Carmona | 220/666 |

* cited by examiner

*Primary Examiner*—Luan K Bui
(74) *Attorney, Agent, or Firm*—Advantia Law Group; Michael W. Starkweather; Jason P. Webb

(57) ABSTRACT

A case for heated appliances. There is a sheath member, a restraining system, and a clip. The sheath member is a single molded piece and includes first and second cradle members and an accordion member coupled to the side edges of the cradle members, thereby forming an enclosure having an opening. The accordion member has a U-shaped cross-section. The restraining system is elongated and is coupled to the sheath by a protruding member through apertures in the restraining system. There is a restraining mode wherein the restraining system compresses the accordion member therebetween. The clip is disposed near an opposite end of the sheath from the restraining system and receives a cord to keep the cord wound about the sheath.

19 Claims, 4 Drawing Sheets

CASE FOR HEATED APPLIANCES

BACKGROUND OF THE INVENTION

1. Field of the Invention

The present invention relates to cases, specifically to cases for heated appliances such as but not limited to curling irons.

2. Description of the Related Art

Heated appliances are used for various tasks and applications. Generally, for cosmetic purposes, heated devices or appliances, e.g. curling irons, hair dryers, straightening irons, crimping irons, etc., are used. A perennial problem is the storage of the appliance immediately after use, when it is still hot. In many instances these devices generate a substantial amount of heat during their use, as well as for a prolonged period of time after use, even when the device is turned off. These devices must therefore be set aside after use when they are hot, thereby posing a potential danger to anyone who would accidentally come into contact with the hot styling instrument.

While barbers, hairstylists and beauticians are careful to maintain these instruments away from themselves, their customers, and others who may walk by the area in which these devices are used, the exposed electrically heated device, such as, for example, a curling iron, still poses a danger in the work area. In some instances, these devices come with collapsible support means to permit the device to rest slightly away from a countertop or other surface. However, although the device may then not be hazardous to a countertop or other items, it is still hot for some time after it is used and remains a potential hazard for those who would accidentally come into contact with its hot portions. Further, adding to the danger is that many of these electrically powered appliances have cords which may also get tangled or disrupted by those passing by or in close proximity to the device. For example, when a curling iron has just been used, the general practice is to set it on a countertop with the hot part raised slightly off of the counter surface. Since the device remains hot for sometime after use, it cannot be simply put away in a drawer or cabinet space. In addition, the device, such as for example, a curling iron, may not be readily transportable immediately after use because of the heat of its portions.

While the stands provided for electrically powered heated appliances used in the beauty and styling trades may have means to prevent a countertop from burning, such as the curling iron stand mentioned above, there exists a need for a device which would prevent injuries, namely burns, caused from accidentally knocking or bumping into the curling iron or cord thereof, and enabling such a heated styling instrument to be immediately portable after use.

Accordingly, some improvements have been made in the field. Examples include but are not limited to the references described below, which references are incorporated by reference herein:

U.S. Pat. No. 5,562,209 by Jackson, et al. discloses a lightweight small personal appliance items for covering storing and protecting curling irons. The items include: a foam rubber outer shell, a layer of insulation, a heat resistant inside lining and an elastic security strap. The curling iron cooler is a single part with the elastic security strap being an attachment.

U.S. Pat. No. 5,141,189 by Andrew discloses a device for holding a curling iron, during and after use, in a safe environment, which comprises base members, resilient clip, and protective heat shield, where the base members provide a means for mounting the device and supports the clip and protective heat shield, the clip firmly grips the curling iron handle, and the protective heat shield surrounds the curling iron barrel, preventing accidental contact with the heated barrel.

U.S. Pat. No. 6,808,066 by Bean discloses a pouch for heated appliances protects external articles from damage from heat emitted from the appliance immediately after use. The pouch is formed of inner and outer fabric sheets, with the inner sheet comprising a heat resistant synthetic material and the outer sheet comprising a durable material for wear resistance. A series of manufacturing steps results in all seams being disposed within the insulating volume between the two plies of material, with the two sheets being joined only along the open top or upper edge of the pouch in order to minimize heat transfer along any common seams. The permanently open top is secured by an adjustably positionable strap which secures between the handle and clip lever of the curling iron, with the open top providing ventilation for the heated appliance. External ties are provided for securing the appliance cord externally to the appliance, to avoid heat damage thereto.

U.S. Patent/Application No. 2005/0161353 by Devine discloses a thermally insulating bag configured to receive a heated hair care device and insulate the device from ambient objects. The bag is capable of receiving multiple shapes, sizes, and types of heated devices, such as curling irons, and straightening irons. Additionally, the bag provides multiple compartments configured to receive and thermally insulate multiple irons from each other, or the cord of a single iron from the heating element portion of the iron. The bag further includes at least one air vent configured to allow a small percentage of hot air to escape from the interior of the bag to the ambient air.

U.S. Pat. No. 5,062,529 by Blair discloses an enclosure for a curling iron or similar article, such as a soldering iron, which includes a partition member to separate the potentially hot elongate heatable element portion and heat insulated handle of the curling iron from the insulated electrical power cord and electrical outlet plug of the curling iron. The enclosure may be mounted on a vertical surface such as a wall or, alternatively, may be placed on a horizontal surface such as a vanity countertop. A cover portion including ventilation means may be removably attached to the enclosure to secure and protect the contents of the enclosure.

The inventions heretofore known suffer from a number of disadvantages which include: failure to adapt to variously sized appliances, failure to adequately shield a user from heat, failure to adequately secure the appliance to the case, failure to adequately secure a cord, difficulty in use, too bulky, and/or difficulty and/or expense in manufacture.

What is needed is a case that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available cases Accordingly, the present invention has been developed to provide a case for heated appliances.

In one embodiment, there is a case for heated appliances. The case includes a sheath member, a restraining system, and/or a clip. A heated appliance may be disposed within the sheath, whereupon the restraining system cinches the sheath member. A cord of the heated appliance may be wrapped about the sheath and an end portion thereof may be secured by the clip.

The sheath member may include a first cradle member having a first top edge and/or a first side edge; a second cradle member having a second top edge and/or a second side edge; and/or an accordion member that may be coupled to the first side edge and/or the second side edge, and/or may form an enclosure having an opening defined by the first top edge and/or the second top edge. The sheath member may further include silicon rubber. The accordion member may have U-shaped cross-section. More, the sheath member may be a single molded piece.

The restraining system may be coupled to the sheath member at the first cradle member and/or at the second cradle member and may have a restraining mode wherein the restraining system compresses the accordion member therebetween. The restraining system may be an elongated member that may encircle the sheath near the first top edge and/or the second top edge. The restraining system may include a coupling protrusion extending from the sheath member; and/or a plurality of apertures having a first width and/or a second width and/or slot that may be smaller than the first width. The plurality of apertures may be disposed in an array along a length of the elongated member and/or may be sized to receive the coupling protrusion. The coupling protrusion may be sized to enable a user to dispose the coupling protrusion through the first width and/or not through the second width and/or slot.

The clip member may be coupled to the first cradle member. The clip member may be disposed near an opposite end of the sheath from the restraining system.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
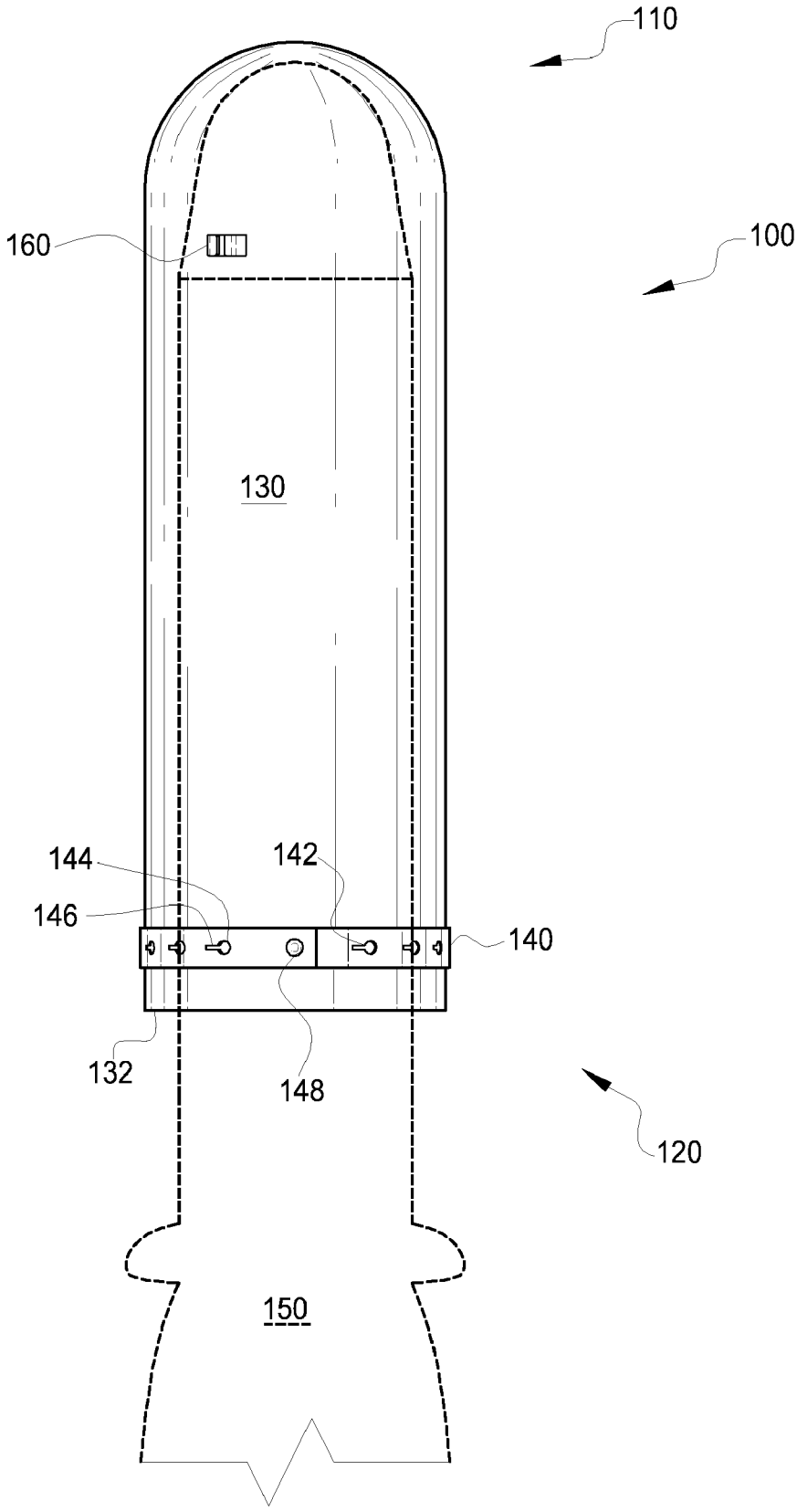
FIG. 1 illustrates a side plan view of a case according to one embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

For clarity it is the convention of this application to number the illustrated portions with a first digit corresponding to the first figure in which that portion appears and is numbered. For example, the coupling assembly 310 first appears numbered in FIG. 3, while the sheath member 100 first appears numbered in FIG. 1.

As used in this application, the term "case" includes covers, enclosures, hoods, bags, capsules, envelopes, and shells.

Looking to the figures, there is shown a case for heated appliances according to one embodiment of the invention. As a non-limiting example, the case may be used to hold, cover, and/or enclose a curling iron for hair. The illustrated case includes a sheath member 100, a restraining system 120, and a clip 160.

In operation, a user may dispose an appliance 150 into the sheath member 100. Once inserted, the user may wrap a cord of the appliance about the exterior of the sheath 100 finally coupling a portion of the cord to the clip 160, thereby fixing the cord about the sheath. The user may also actuate the restraining system 120 to tighten the sheath 100 about the appliance 150, especially near a top edge 132 and 232 of the sheath 100. Because of the unique shape of the sheath 100, the sheath 100 tightens securely about the appliance 150 even where the appliance 150 includes one or more irregular shaped portions. Further, the sheath 100 has enhanced coupling characteristics along the length of the inserted appliance 150, as will be explained later in this description.

Looking now to the particular details of the illustrated embodiment, the illustrated sheath member 100 includes a first cradle member 130 having a first top edge 132 and a first side edge 220. There is also a second cradle member 230 having a second top edge 232 and a second side edge 240. Coupled between the first cradle member 130 and the second cradle member 230 is an accordion member 210. The accordion member 210 is coupled to the first side edge 220 and the second side edge 240, thereby forming an enclosure having an opening 510 defined by the first top edge 132 and the second top edge 232. The sheath member 100 defines a cavity wherein may be disposed the appliance 150.

The accordion member 210 includes a plurality of angled members 212 and 214 angled in alternating directions. Accordingly, the accordion member 210 is biased with a flexible effective width. Force applied to the width of the accordion member may cause the accordion member 210 to change in width, by increasing and/or decreasing the distance between the first cradle member 130 and the second cradle member 230, thereby enabling a user to alter a cavity size within the sheath 100.

Figure 2:
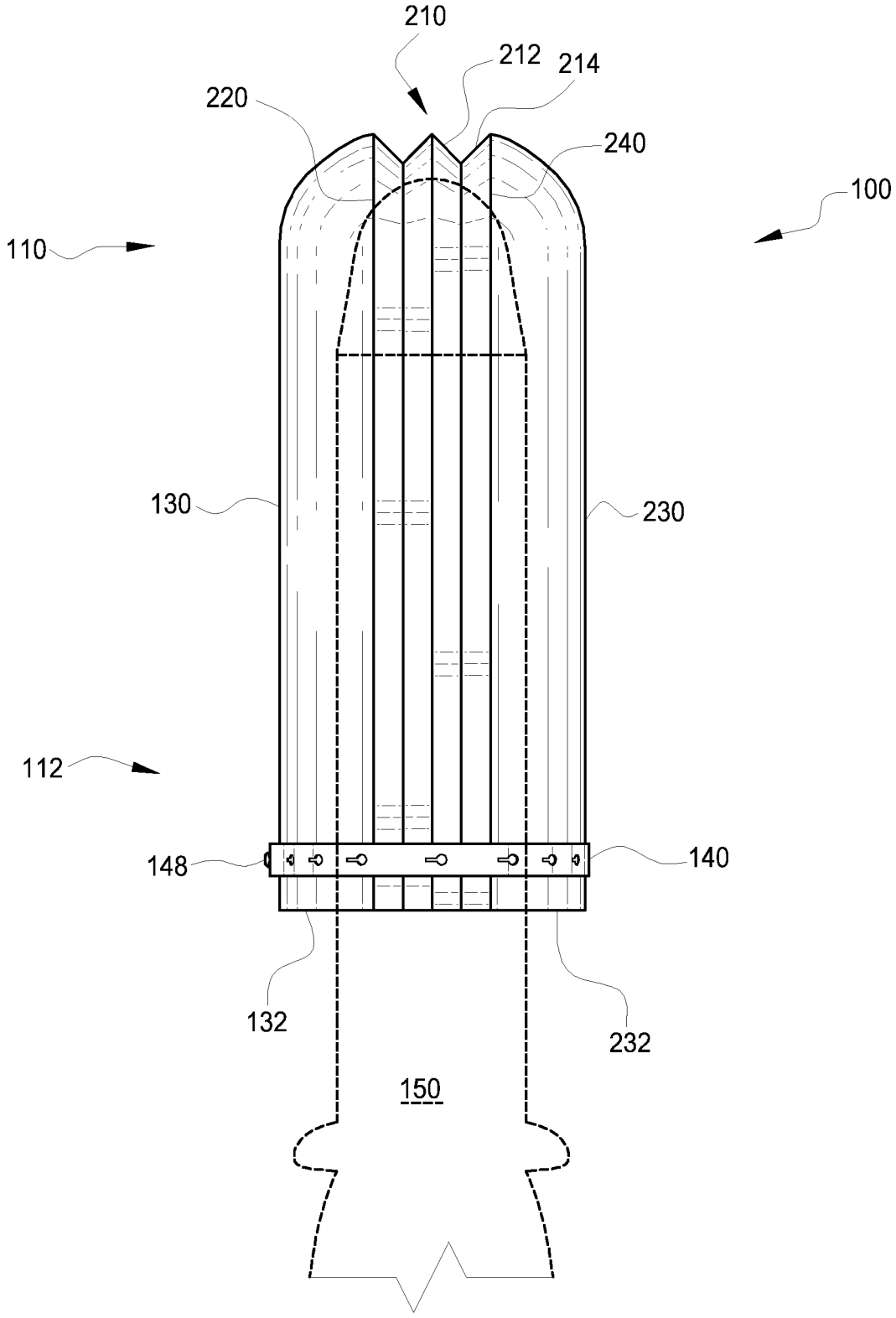
FIG. 2 illustrates a side plan view of a case according to one embodiment of the invention.
Figure 3:
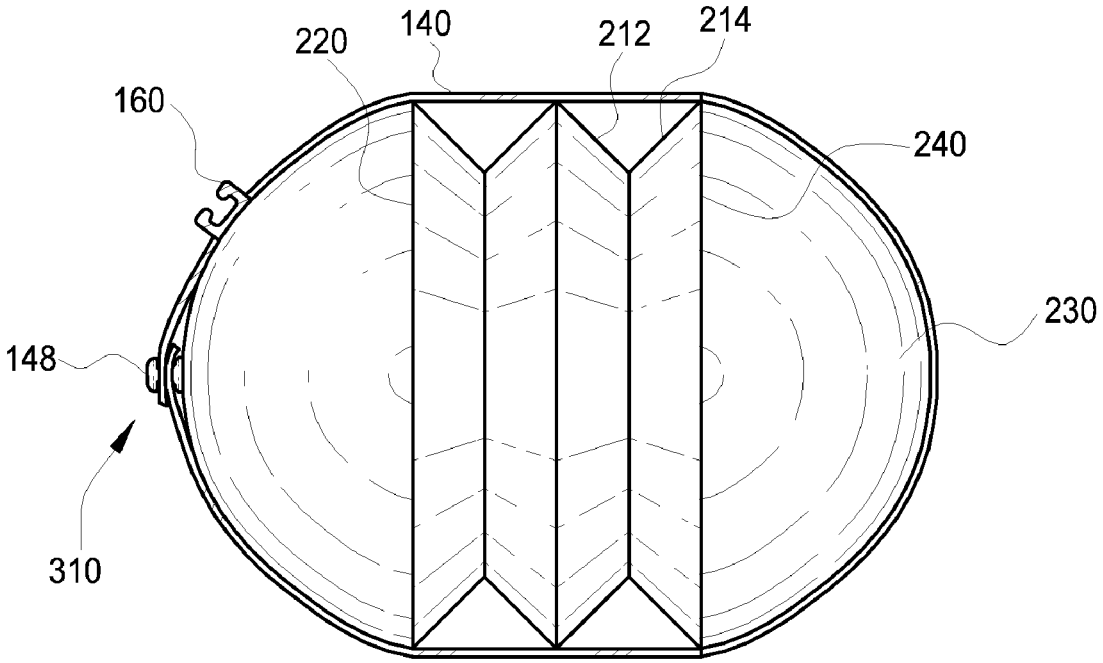
FIG. 3 illustrates a bottom plan view of a case according to one embodiment of the invention.
Figure 4:
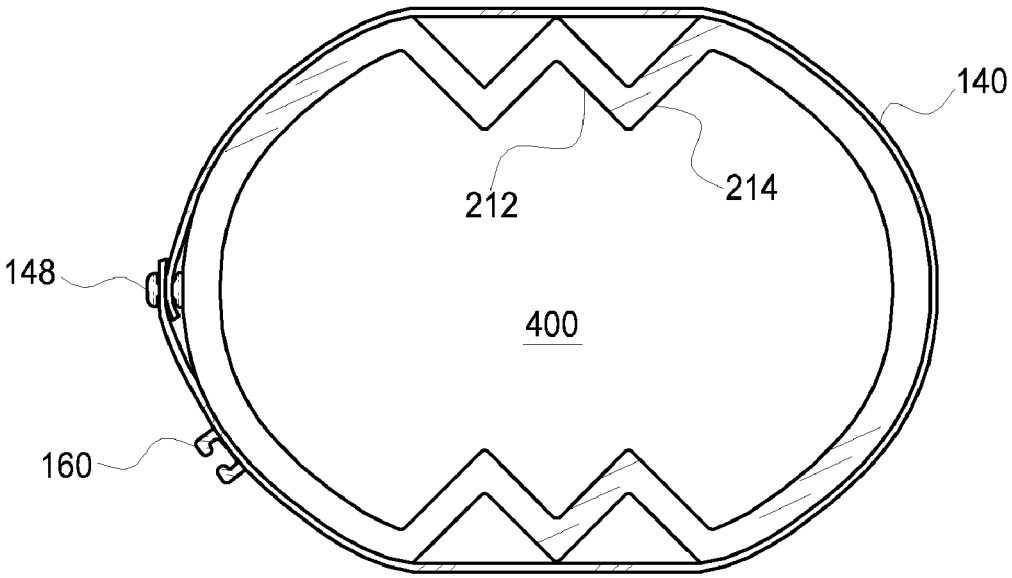
FIG. 4 illustrates a top plan view of a case according to one embodiment of the invention.
Figure 5:
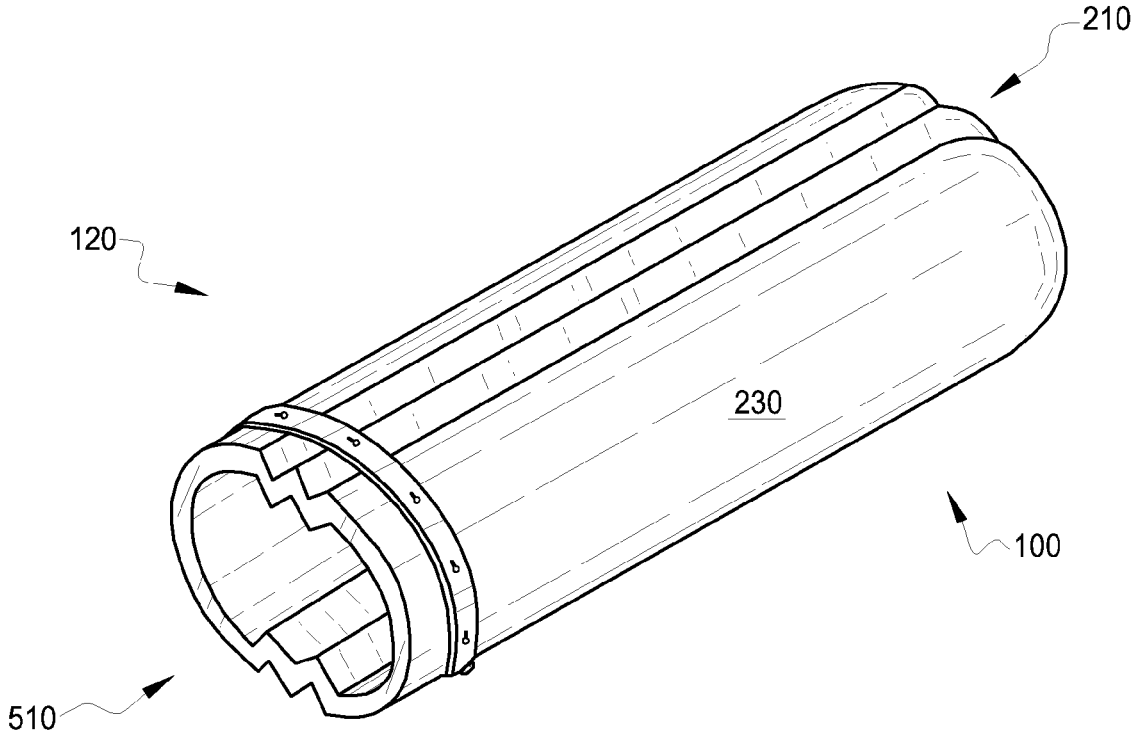
FIG. 5 illustrates a perspective view of a case according to one embodiment of the invention.

In the illustrated embodiment the accordion member includes a U-shaped cross-section as shown in FIGS. 2, 3, and 4, wherein the cradle members 130 and 230 are spaced by the accordion member 210 and not in direct contact one to another. It is understood that the accordion member 210 may extend only over one side of the sheath member 100 in one embodiment and may or may not extend over a bottom 110 portion of the sheath member 100. For example, the mirror image of FIG. 2 might not show the accordion member 210, and/or the mirror image of FIG. 3 might not show the accordion member 210.

In one embodiment, the sheath member includes silicon rubber. In another embodiment, the sheath member consists essentially of silicone rubber. Silicone rubber polymers have a backbone of silicon oxygen linkages, the same bond that is found in quartz, glass, and sand. This is one of the main reasons that silicone rubber has such excellent high temperature properties, such as low conductivity of heat. Organic rubber has a carbon to carbon backbone. This can leave them susceptible to ozone, UV, heat and other aging factors that silicone rubber can withstand well. Further, silicone rubber has been well tested by Underwriter Laboratories, Inc. to evaluate its properties and safety. Accordingly, silicone rubber is a material of choice in many extreme environments.

Silicone rubber offers incredible resistance to extreme temperatures, being able to operate normally from minus 100° C. to plus 300° C. or higher. In such conditions the tensile strength, elongation, tear strength and compression set can be far superior to conventional rubbers.

There are also many specialist grades of silicone rubber that offer the following qualities: steam resistance, metal detectable, glow in the dark, electrically conductive, chemical/oil/acid/gas resistance, low smoke emission and flame retardent.

Once milled and coloured the silicone rubber can be extruded into tubes, strips, solid cord or custom profiles within the size restrictions of the manufacturer. Cord can be joined to make "O" Rings and extruded profiles can also be joined to make up seals.

Silicone Rubber can also be moulded into custom shapes and designs. Heat is required to vulcanise (set) the silicone rubber. Vulcanization is normally carried out in a two-stage process at the point of manufacture into the desired shape, and then in a prolonged post-cure process.

In one embodiment, the sheath member 100 comprises a single molded and/or extruded piece.

The illustrated restraining system 120 is coupled to the sheath member 100 at the first cradle member 130 and at the second cradle member 230. The restraining system 120 has a restraining mode wherein the restraining system 120 compresses the accordion member 210 therebetween. The illustrated restraining system 120 further comprises an elongated member 140 encircling the sheath member 100 near the first top edge 132 and the second top edge 232.

The illustrated restraining system 120 further comprises a coupling protrusion 148 extending from the sheath member 100. There is also shown a plurality of apertures 142 having a first width 144 and a second width or slot 146 smaller than the first width 144. The illustrated plurality of apertures 142 are disposed in an array along a length of the elongated member 140 and sized to receive the coupling protrusion 148.

The illustrated coupling protrusion 148 is sized relative to the first and second widths 144 and 146 to enable a user to dispose the coupling protrusion 148 through the first width 144 and not through the second width or slot 146. The orientations of the plurality of apertures 142 provide that expansive force may be applied from the sheath member 100, which may increase the effective length of the elongated member 140, and may thereby direct the coupling protrusion 148 from a portion of an aperture 142 of a first width 144 to that of a second width or slot 146, thereby securing the coupling protrusion 148 therein.

Further, the illustrated elongated member 140 is coupled to the coupling protrusion 148 near a first end, wrapped about the sheath member 100, and then removably coupleable to the coupling protrusion 148 at a plurality of positions spaced from the first end of the elongated member 140.

Accordingly, the user may cinch the elongated member 140 about the sheath member 100, altering an effective length/circumference of the elongated member 140. This enables the user to compress the sheath member 100, thereby applying a force to the accordion member 210 which may bend in response, thereby reducing an effective volume and/or interior width of the sheath member 100. Advantageously, this may more securely couple the sheath member 100 to an appliance, such as by frictional coupling. Further, coupling enhancement may be provided by the clip member 160.

The illustrated clip member 160 is coupled to the first cradle member 130 near a bottom portion 110 of the sheath member 100 (near an opposite end of the sheath member 100 from the restraining system 120). Accordingly, a cord, such as, but not limited to a power cord of an appliance, may be wrapped about the sheath member 100 winding towards the clip member 160. At a desired point on the cord, the cord may be coupled to the clip member 160, as the clip member 160 has biased arms defining a narrowed portion through which a portion of the cord may be disposed and therein held. As a user may wrap the cord according to a desired tension, such may further apply force to the accordion member 210, thereby further enhancing coupling of the sheath member 100 to the appliance 150.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

It is expected that there could be numerous variations of the design of this invention. An example is that there may be ornamentation on a surface thereof that may include relief work and/or protrusions. There may be coloring and/or patterning thereon. The shape of an embodiment may vary from the exact design illustrated. There may be ribs, bubbles, protrusions, cavities, etc.

Further, while the accordion member is shown as having substantially sharp angular zig-zag portions 212 and 214, wherein the change from one portion to another is characterized by a sharp change in angle, it is understood that the change may be characterized by a curve or another similar shape. More, the curvature of the zig-zag may be different along different portions of the sheath.

Finally, it is envisioned that the components of the device may be constructed of a variety of materials, such as plastics, rubbers, natural fibers, woven materials, metals, ceramics, and composites. Further, while silicone rubber is disclosed as a material of choice, it is understood that in one embodiment of the invention any material having sufficient thermal resistivity (low thermal conductivity) and flexibility may be used. In another embodiment, a plurality of materials may be used, such as, but not limited to, using a rigid material for the cradles and a flexible material for the accordion member.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A case for heated appliances, comprising:
a sheath member including:
a first cradle member having a first top edge and a first side edge;
a second cradle member having a second top edge and a second side edge; and
an accordion member coupled to the first side edge and the second side edge, thereby forming an enclosure having an opening defined by the first top edge and the second top edge; and
a restraining system being an elongated member encircling the sheath member near the first top edge and the second top edge, coupled to the sheath member at the first cradle member and at the second cradle member and having a restraining mode wherein the restraining system compresses the accordion member therebetween.

2. The case of claim 1, further comprising a clip member coupled to the first cradle member.

3. The case of claim 1, wherein the sheath member further comprises silicone rubber.

4. The case of claim 1, wherein the restraining system further comprises:
a coupling protrusion extending from the sheath member; and
a plurality of apertures having a first width and a second width smaller than the first width, the plurality of apertures disposed in an array along a length of the elongated member and sized to receive the coupling protrusion, wherein the coupling protrusion is sized to enable a user to dispose the coupling protrusion through the first width and not through the second width.

5. The case of claim 1, wherein the accordion member includes a U-shaped cross-section.

6. The case of claim 2, wherein the clip member is disposed near an opposite end of the sheath from the restraining system.

7. The case of claim 1, wherein the sheath member comprises a single molded piece.

8. A case for heated appliances, comprising:
a sheath member including:
a first cradle member having a first top edge and a first side edge;
a second cradle member having a second top edge and a second side edge; and
an accordion member coupled to the first side edge and the second side edge, thereby forming an enclosure having an opening defined by the first top edge and the second top edge;
a restraining system coupled to the sheath member at the first cradle member and at the second cradle member and having a restraining mode wherein the restraining system compresses the accordion member therebetween; and
a clip member coupled to the first cradle member.

9. The case of claim 8, wherein the accordion member includes a U-shaped cross-section.

10. The case of claim 9, wherein the restraining system further comprises an elongated member encircling the sheath member near the first top edge and the second top edge.

11. The case of claim 10, wherein the sheath member further comprises silicone rubber.

12. The case of claim 11, wherein the restraining system further comprises:
a coupling protrusion extending from the sheath member; and
a plurality of apertures having a first width and a second width smaller than the first width, the plurality of apertures disposed in an array along a length of the elongated member and sized to receive the coupling protrusion, wherein the coupling protrusion is sized to enable a user to dispose the coupling protrusion through the first width and not through the second width.

13. The case of claim 12, wherein the clip member has two biased arms extending from the first cradle member.

14. The case of claim 13, wherein the clip member is disposed near an opposite end of the sheath from the restraining system.

15. The case of claim 14, wherein the sheath member comprises a single molded piece.

16. A case for heated appliances, consisting essentially of:

a sheath member including:

a first cradle member having a first top edge and a first side edge;

a second cradle member having a second top edge and a second side edge; and an accordion member coupled to the first side edge and the second side edge, thereby forming an enclosure having an opening defined by the first top edge and the second top edge;

a restraining system, being an elongated member encircling the sheath member near the first top edge and the second top edge, coupled to the sheath member at the first cradle member and at the second cradle member and having a restraining mode wherein the restraining system compresses the accordion member therebetween; and a clip member coupled to the first cradle member near an opposite end of the sheath from the restraining system.

17. The case of claim 16, wherein the restraining system further comprises:

a coupling protrusion extending from the sheath member; and a plurality of apertures having a first width and a second width smaller than the first width, the plurality of apertures disposed in an array along a length of the elongated member and sized to receive the coupling protrusion, wherein the coupling protrusion is sized to enable a user to dispose the coupling protrusion through the first width and not through the second width.

18. The case of claim 17, wherein the accordion member includes a U-shaped cross-section.

19. The case of claim 18, wherein the sheath member comprises a single molded piece.

* * * * *